US011197528B2

(12) United States Patent
Croibier

(10) Patent No.: US 11,197,528 B2
(45) Date of Patent: Dec. 14, 2021

(54) PULL-OPENING CAP EQUIPPED WITH AN AIR INTAKE

(71) Applicant: L'OREAL, Paris (FR)

(72) Inventor: Sébastien Croibier, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/648,855

(22) PCT Filed: Oct. 1, 2018

(86) PCT No.: PCT/EP2018/076626
§ 371 (c)(1),
(2) Date: Jun. 26, 2020

(87) PCT Pub. No.: WO2019/068629
PCT Pub. Date: Apr. 11, 2019

(65) Prior Publication Data

US 2020/0383454 A1 Dec. 10, 2020

(30) Foreign Application Priority Data

Oct. 2, 2017 (FR) ..... 1759192

(51) Int. Cl.
*A45D 34/04* (2006.01)
*B05B 11/00* (2006.01)
*B67D 3/00* (2006.01)

(52) U.S. Cl.
CPC ..... *A45D 34/04* (2013.01); *B05B 11/0097* (2013.01); *B67D 3/0029* (2013.01)

(58) Field of Classification Search
CPC ..... A45D 34/04; B05B 11/0097; B05B 15/62; B67D 3/0029
See application file for complete search history.

(56) References Cited

U.S. PATENT DOCUMENTS 4,474,314 A * 10/1984 Roggenburg, Jr. ..... B65D 47/2081 222/494
4,711,378 A 12/1987 Anderson
5,104,008 A * 4/1992 Crisci ..... B65D 47/243 222/153.07
5,927,565 A 7/1999 Paczonay
6,321,924 B1 * 11/2001 Yurkewicz ..... B65D 51/18 215/251
7,275,665 B2 * 10/2007 Young ..... B65D 47/0838 215/307

(Continued)

FOREIGN PATENT DOCUMENTS

EP 1306314 A1 5/2003
GB 343328 A 2/1931

(Continued)

OTHER PUBLICATIONS

International Search Report for counterpart Application No. PCT/EP2018/076626, dated Dec. 19, 2018.

*Primary Examiner* — Vishal Pancholi
(74) *Attorney, Agent, or Firm* — The Marbury Law Group, PLLC

(57) ABSTRACT

The invention relates to a capsule (1) having a push-pull opening along longitudinal axis X, comprising a fixed housing (3) as well as a head (4) which can move translationally along axis X with respect to the fixed housing (3), said capsule comprising an air intake passage (16).

13 Claims, 5 Drawing Sheets

(56) References Cited

U.S. PATENT DOCUMENTS

| | | | |
|---|---|---|---|
| 2003/0089735 | A1 | 5/2003 | Iwatsubo |
| 2004/0251277 | A1 | 12/2004 | Tang |

FOREIGN PATENT DOCUMENTS

| | | | |
|---|---|---|---|
| WO | 01/45798 | A1 | 6/2001 |
| WO | 01/68455 | A1 | 9/2001 |

* cited by examiner

PULL-OPENING CAP EQUIPPED WITH AN AIR INTAKE

CROSS-REFERENCE TO RELATED APPLICATIONS

This is a national stage application of PCT/EP2018/076626, filed internationally on Oct. 1, 2018, which claims priority to French Application No. 1759192, filed on Oct. 2, 2017, all of which are incorporated by reference herein by their entireties.

TECHNICAL FIELD

The present invention relates to a pull-opening cap also known as a "push-pull cap". It is also aimed at a dispenser comprising a container, containing in particular a cosmetic product, and such a cap, and also a method comprising the use of this dispenser.

Within the meaning of the present invention, a "cosmetic product" is understood to be a cosmetic product intended to be applied to a human being, for example a liquid or a cream. A "cosmetic product" is more generally a product as defined in Regulation (EC) No 1223/2009 of the European Parliament and of the Council of Nov. 30, 2009 on cosmetic products.

BACKGROUND

General Technological Background

Various pull-opening caps have already been proposed, for example by WO200145798, WO200168455 or U.S. Pat. No. 4,711,378.

Nevertheless, the flow of the product at the outlet of the known caps is quite slow. In addition, their construction is relatively complex and expensive.

In particular, it is not very profitable to use these known caps as a system for dispensing cosmetic product from a reservoir of large size. For example, fitting them to a shampoo reservoir at a hair salon is not economical, as too much time is needed to withdraw the product.

There is a need to propose a pull-opening cap which is simple, ergonomic, intuitive and hygienic, and which dispenses the product in an economically acceptable amount of time.

Definition of the Invention

A subject of the invention, according to one of its aspects, is a pull-opening cap of longitudinal axis X, having on the one hand a fixed body fitted with a relief for fastening to a neck of a container containing a product, and on the other hand a head able to move in translation along the axis X relative to the fixed body, the mobile head defining a product outlet orifice, the fixed body and the mobile head together delimiting an internal passage for dispensing the product, and the mobile head being movable between a position for blocking the dispensing of the product and a position for dispensing the product at the outlet orifice, the cap having an air intake passage.

By virtue of the air intake passage, the flow rate of the product from the container to the outlet orifice is markedly improved. This flow rate may be increased at least by a factor of five for certain products, including for viscous products such as shampoos or creams for conditioning the hair.

Thus the cap according to the invention may be used to fill product refills at a business, for example to fill shampoo refills for the customers of a hair salon from an industrial shampoo canister. The waiting time during this operation is very acceptable to the customer.

A further subject of the invention is a cosmetic dispensing device comprising a container fitted with a cap as described above.

A further subject of the invention is a cosmetic method comprising the operations consisting in:

- providing a cosmetic device as described above,
- providing and opening a bottle,
- placing the open bottle under the dispensing orifice of the cap,
- opening the cap by moving the mobile head away from the fixed part,
- letting the product flow until the bottle is filled to the desired level,
- closing the cap by moving the mobile head closer to the fixed part,
- moving the bottle away from the device,
- closing the bottle again.

Main Definitions

The "axis X" means the longitudinal axis X.

The "longitudinal axis X of a component" is understood to be the curve connecting all the centers of mass of the transverse sections of the component.

A "transverse section along the axis X" is understood to be a section perpendicular to the axis X, by extension.

A "lateral wall" is understood to be a wall parallel to the axis X.

A "transverse wall" is understood to be a wall perpendicular to the axis X.

Preferred Embodiments

Preferably, the cap according to the invention has one or more of the following features, taken alone or in combination:

- The air intake passage is formed in the fixed body. The construction is simplified.
- The product outlet orifice forms an orifice for the passage of the air entering or leaving the air intake passage. The flow is stopped more cleanly. Indeed, if there are two distinct outlet orifices, one for the air and the other for the product, product may dry in the air intake channel and may leak via the latter.
- The air intake passage extends along the axis X or parallel to the axis X. The effectiveness of the air intake is high.
- The air intake passage is a channel, a shaft or a groove. These geometries are appropriate for the shape of the cap, especially if it has cylindrical skirts.
- The air intake passage is formed inside a cylindrical skirt. The production is optimal.
- The air intake passage is remote from the axial ends of the fixed body. The effectiveness is improved.
- It has outer collars for fastening to a support.

Preferably, the device according to the invention has one or more of the following features, taken alone or in combination:

- The container is held in the vertical position by a support. The holding of the container is made easier.
- The cap may be actuated by a handle secured to the support. The action of the user is simplified.

DESCRIPTION OF THE FIGURES

The invention may be better understood upon reading the following detailed description of nonlimiting exemplary embodiments thereof, and upon studying the attached schematic and partial drawing, in which.

Figure 1:
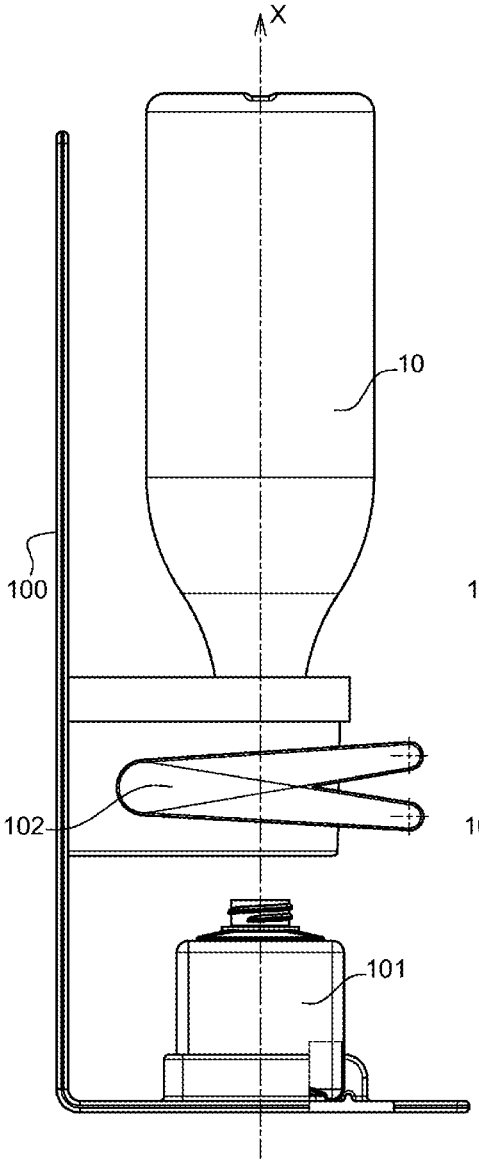
FIG. 1 schematically shows an example of a cosmetic dispensing device according to the invention, in a position in which a cap is closed, FIG. 2 schematically shows an example of a cosmetic dispensing device according to the invention, in a position in which a cap is open.

The cosmetic assembly with longitudinal axis X shown in FIG. 1 is preferably intended for dispensing liquid or gel cosmetic products, for example a shampoo or a dyeing cream. To this end, it comprises a device according to the invention held vertically on a table by a support 100. The latter is fitted with a handle 102 for actuating the cap 1.

The cosmetic product has a viscosity which may range for example from 5 poises to 250 poises (0.5 to 25 Pa·s) and preferably from 35 poises to 200 poises (3.5 to 20 Pa·s), the viscosity being measured at 25° C. with a Rheomat 180 measuring apparatus at 200 $s^{-1}$, this apparatus being fitted with a different spindle depending on the viscosity, for example a No. 2 spindle for ranges of viscosities less than 7 poises, a No 3 spindle for ranges of viscosities from 2 to 40 poises and a No. 4 spindle for ranges of viscosities greater than 20 poises.

The device is formed by a container 10 provided with a cap 1 according to the invention. The cap 1 is provided with a dispensing head 3 able to move axially while capping the product container 10. It is provided with a dispensing passage 5 delimiting a product outlet orifice 2 visible in FIG. 2.

A bottle 101 is placed under the device according to the invention so as to be filled with product from the container 10.

Figure 2:
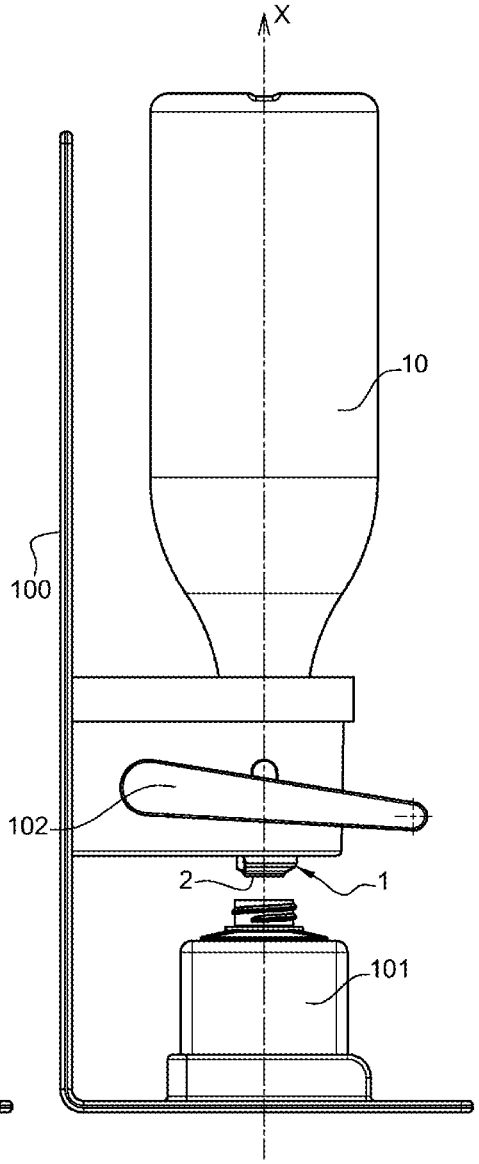

In FIG. 1, the handle 102 is raised to a high position. The cap 1 is closed. In FIG. 2, the handle 102 is lowered to a low position. The cap 1 is open. The product flows from the container 10 to the bottle 101.

The cap could be actuated by means other than the handle 102, such as a control button, a knob or an electronic control for example.

Figure 3:
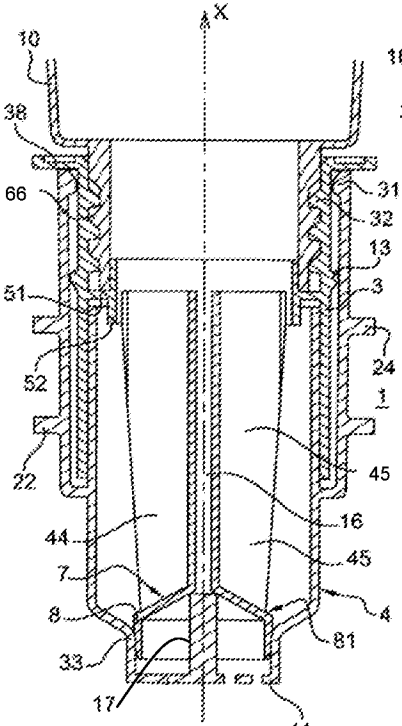
FIG. 3 shows in isolation a longitudinal cross section through a first cap in the closed position.

The cap 1 with axis X shown in FIG. 3 is in the closed position. It has a fixed body 3 on which is mounted a head 4 able to move in translation along the axis X.

The fixed body may be produced by molding, in particular as a single component and/or by injecting a plastic material, in particular acrylic, cellulose-based, styrene or vinyl materials, polycarbonates, polyamides, polyolefins or polyethylene terephthalate. Generally, materials from the family known as "thermoplastic resins" are used.

The mobile head 4 comprises two external collars 22 and 24 between which the actuating handle 102 may be inserted. One of the collars may be truncated so as to make grasping easier.

The fixed body 3 has a guiding skirt 36 provided with an internal thread 32 for fastening it to external ribs 66 of the container 10. Other fastening means may be envisaged such as force-fitting, snap-fastening or clip-fastening.

The guiding skirt 36 is provided on the outside with a blocking rib 13 which may engage with a complementary blocking rib 31 formed on the internal wall of the mobile component. The ribs 13 and 31 limit the travel of the mobile head 4 downward when the cap 1 is opened. Other complementary blocking reliefs could be envisaged such as threads, rods or continuous or discontinuous beads.

The guiding skirt 36 may be connected to a fastening skirt (not shown) by a transverse wall 38 ensuring the upward blocking of the mobile component 4 so as to close the cap 1. Other means for blocking the mobile component 4 of the cap 1 may be envisaged, for example complementary reliefs formed on the fixed body 3 and on the mobile head 4.

The guiding skirt 36 may be provided on the outside with longitudinal ribs promoting the guiding of the mobile head 4.

The guiding skirt 36 is connected by a transverse wall 51 to a fastening ring 52 on which longitudinal guiding walls 44, 45 may be mounted. When the mobile head 4 and the fixed body 3 are joined together, the guiding walls 44, 45 delimit with the mobile head 4 an inner space 39 which may be divided into guiding lanes 15 regularly distributed about the axis X.

The guiding walls 44, 45 extend between the axis X and the internal surface of the guiding skirt 36, while protruding from the guiding skirt 36 at the bottom so as to accompany the flow of product over an optimal height via the guiding lanes 15. The guiding lanes 15 may improve the flow of product in the cap 1.

In the example shown, there are three guiding walls 44, 45 (only two being visible in the figures) but this does not have to be the case.

A shut-off member 7 is arranged at the end of the fixed body 3 in the continuation of the guiding walls. When the cap 1 is in the open position, the shut-off member 7 is away from the mobile head 4. The product may flow through the outlet orifice 11. When the cap 1 is in the closed position, the shut-off member 7 is in contact with the mobile head 4. It shuts off the product outlet orifice 11.

The shut-off member 7 may have a lateral skirt 8 having an external surface and a conical skirt 81. At rest it adopts a shut-off position in which it rests via the skirt 8 against a bearing surface 33 of the head 4, which has an internal surface that contacts the product when it flows through the orifice 11. The shut-off member 7 may move away from this bearing surface 33 when the user pulls on the mobile head 4. The product flows under the effect of the pressure of the product contained in the container 10 when the product is dispensed.

In the example shown, the shut-off member 7 is borne by the guiding walls and is produced in one piece therewith. This does not have to be the case.

Advantageously, the deflector 81 may be formed by a wall of the shut-off member 7 and is arranged obliquely relative to the axis X. The deflector 81 may serve as a baffle for regulating the flow of the product.

Figure 4:
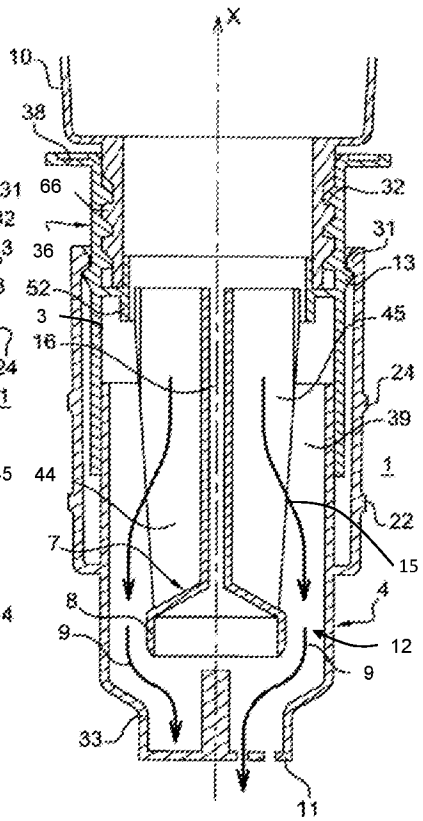
FIG. 4 shows in isolation a longitudinal cross section through the cap in FIG. 3 in the open position.

The cap 1 shown in FIG. 4 is in the open position. The arrows indicated in this figure indicate the path of the product. The product may flow from the container 10 to the outlet orifice 11, passing through the lanes 15 of the fixed component and then bypassing the shut-off member 7 via the annular space 12, so as to reach an ejection channel 9 defined by the mobile head 4 and to emerge outside the cap 1 via the outlet orifice 11.

In the example shown, the path of the product is delimited by a passage comprising:

the three guiding lanes 15, the ejection channel 9, the annular space 12.

Of course, the passage could have any other shape, in particular depending on the transverse sections of the various components.

As soon as actuation of the mobile head 4 is stopped, the product remaining in the passage is protected from the air by virtue of the shut-off member 7.

In accordance with the invention, the cap 1 has a central air intake passage 16 borne by the guiding walls. The air intake passage 16 is formed in the fixed body 3 and forms a central shaft of axis X for conveying air to the container 1. When the cap 1 is in the closed position, a stopper 17 may close the inlet of the air intake passage 16 as shown in FIG. 3.

When the cap 1 is in the open position, the inlet of the air intake passage 16 is clear as shown in FIG. 4. The air is in communication with the product contained in the container 10 via the passage 16, throughout the duration of filling of the bottle 101. Indeed, the end of the passage 16 emerges into the neck of the container 10.

Figure 6:
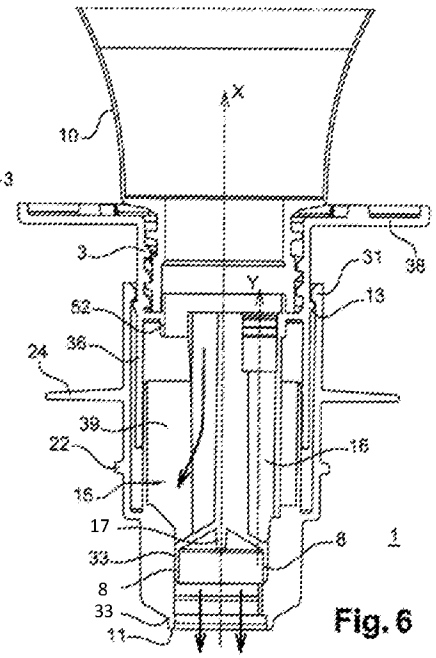
FIG. 6 shows in isolation a longitudinal cross section through the cap in FIG. 5 in the open position.
Figure 5:
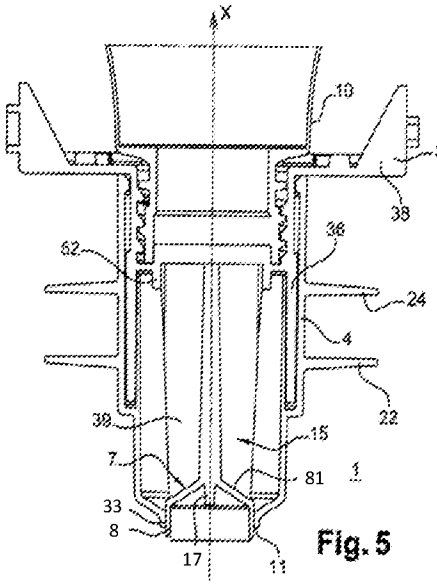
FIG. 5 shows in isolation a longitudinal cross section through a second cap in the closed position.

The cap 1 shown in the closed position in FIG. 5 and in the open position in FIG. 6 is essentially identical to that shown in FIGS. 3 and 4, apart from the fact that the air intake passage 16 is no longer a shaft of axis X but a shaft of axis Y parallel to the axis X. The passage 16 is connected to the ring 52 and to a guiding wall, and is in contact with the latter over its entire height.

Figure 7:
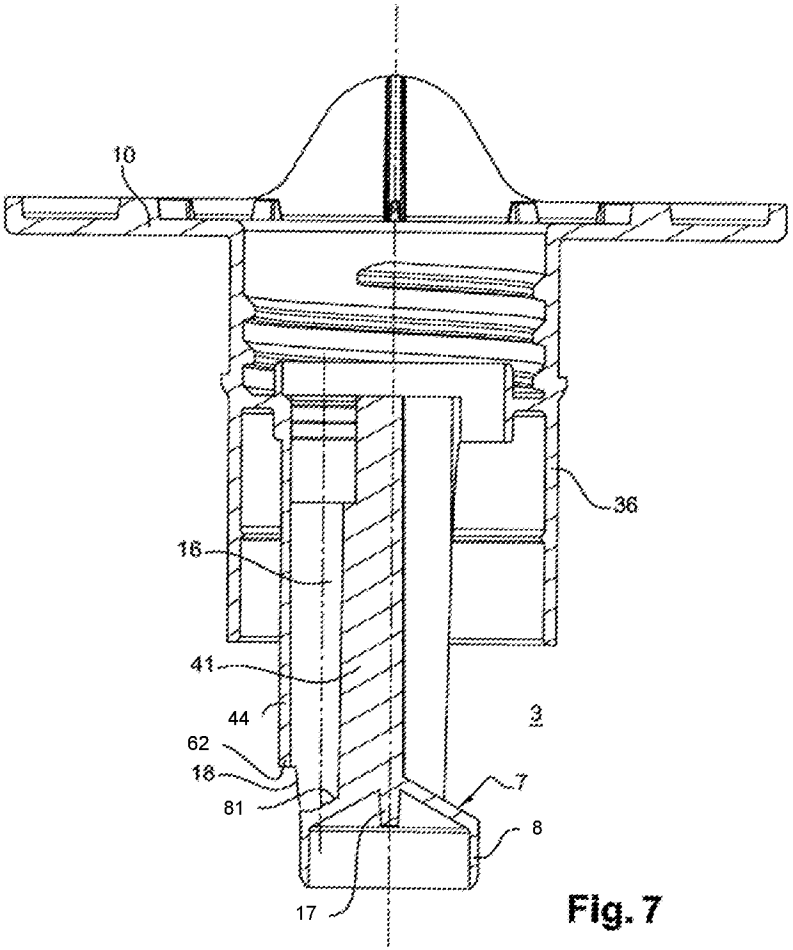
FIG. 7 shows a longitudinal cross section through the fixed body of the cap in FIGS. 5 and 6.

FIG. 7 shows the structure of the fixed body 3 having the air intake passage 16 offset relative to the axis X. In the example shown, the air intake passage 16 extends inside the wall 44 and terminates at an air inlet orifice 18 disposed adjacent to the shut-off member 7.

In the example represented, the air intake passage 16 is situated between the guiding walls 41, 44, but this does not have to be the case.

Figure 8:
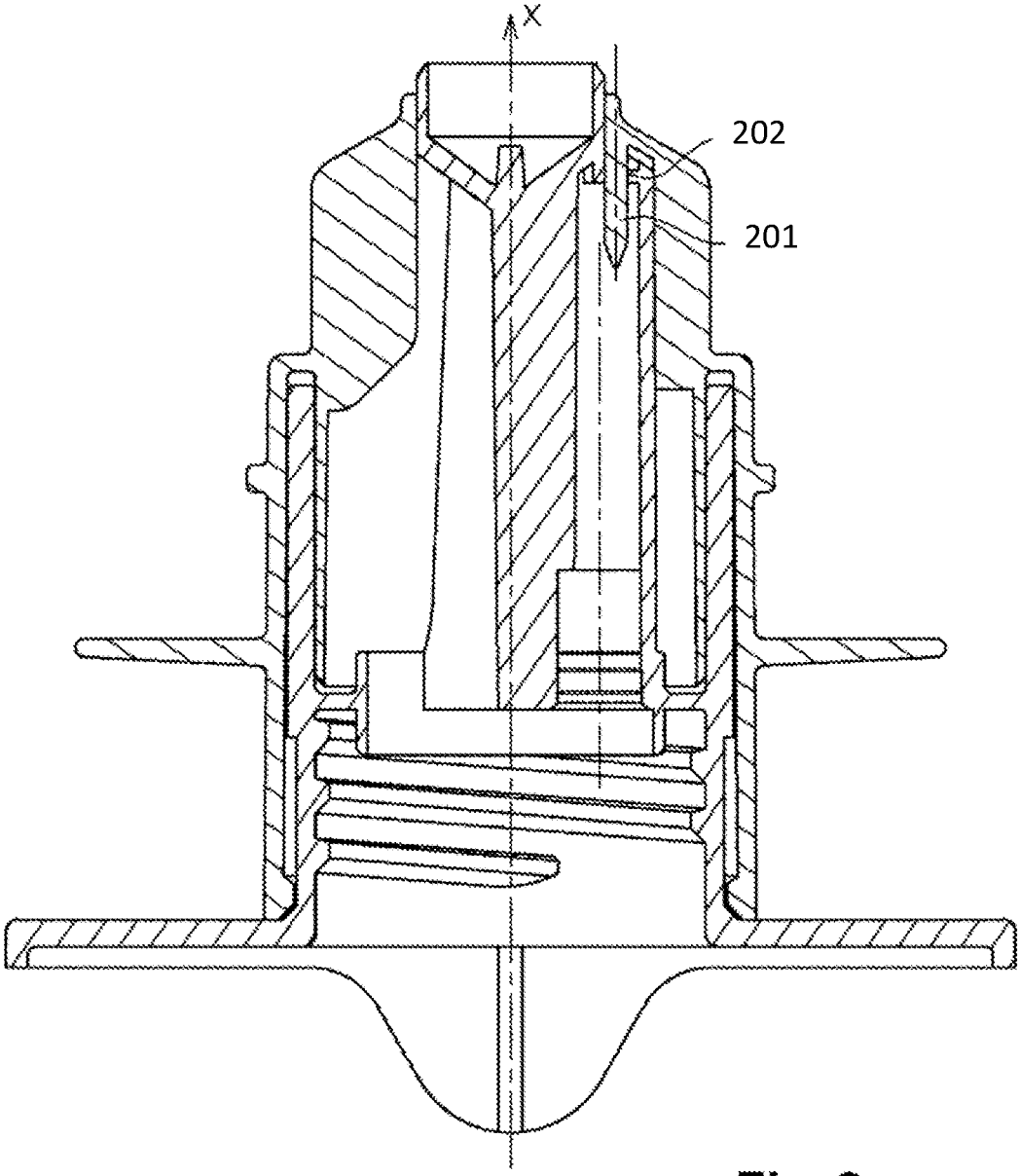
FIG. 8 shows in isolation a longitudinal cross-section through a cap with improved sealing.

In FIG. 8, the cap shown also has an air intake via a spike 201 which enters an orifice 202 allowing the system to be used with more fluid liquids.

Of course, the invention is not limited to the exemplary embodiments illustrated. The fixed body 3 and the mobile head 4 could have any other structure or shape. Likewise, the air intake passage could be arranged differently or could have another shape.

The invention claimed is:

1. A pull-opening cap comprising:

a fixed body comprising:

a guiding skirt configured to be fastened to a neck of a container containing a product;

guiding walls that extend from the guiding skirt and at least partially define guiding lanes and an air intake passage; and a shutoff member extending from the guiding walls; and a mobile head disposed around the fixed body and comprising a product outlet, the mobile head configured to move relative to the fixed body, between an open position and a closed position, wherein, in the open position, the shutoff member is configured to open the product outlet, such that the product is permitted to flow out of the container, along the guiding lanes, past the shutoff member, and then out of the cap through the product outlet, and air is permitted to flow between the product outlet and the container, via the air intake passage, and in the closed position, the shutoff member is configured to block the product outlet and prevent the product from flowing out of the cap.

2. The cap of claim 1, further comprising a stopper that extends from the mobile head and is configured to block an inlet of the air intake passage when the mobile head is in the closed position.

3. The cap of claim 1, further comprising:

a transverse wall and a blocking rib that extend from the guiding skirt; and a locking rib that extends from the mobile head, wherein, in the open position, the locking rib is configured to contact the blocking rib, and in the closed position, the locking rib is configured to contact the transverse wall.

4. The cap of claim 1, wherein the air intake passage extends along a longitudinal axis of the cap.

5. The cap of claim 1, wherein the air intake passage extends parallel to a longitudinal axis of the cap.

6. The cap of claim 1, wherein the air intake passage is a channel, a shaft, or a groove.

7. The cap of claim 1, further comprising outer collars that extend from an outer surface of the mobile head.

8. A pull-opening cap comprising:

a fixed body comprising:

a guiding skirt configured to be fastened to a neck of a container containing a product;

guiding walls that extend from the guiding skirt and at least partially define guiding lanes and an air intake passage; and a shutoff member extending from the guiding walls and comprising:

a conical diverter that extends from the guiding walls; and a cylindrical skirt that extends from the diverter; and a mobile head disposed around the fixed body and comprising a product outlet, the mobile head configured to move relative to the fixed body, between an open position and a closed position, wherein, in the open position, the shutoff member is configured to open the product outlet, such that the product is permitted to flow out of the container, along the guiding lanes, past the shutoff member, and then out of the cap through the product outlet, and in the closed position, the shutoff member is configured to block the product outlet and prevent the product from flowing out of the cap.

9. A cosmetic dispensing device comprising:

a container comprising a cosmetic composition;

the cap of claim 1 fitted to an outlet of the container; and a support configured to hold the cap, such that the container is disposed above the cap.

10. The device of claim 9, wherein the support comprises a handle configured to actuate the cap.

11. The device of claim 10, wherein the support is configured to support the cap above a table, such that the cap can selectively deliver a cosmetic product to a bottle disposed on the table, below the cap.

12. A method for dispensing a cosmetic composition comprising:

placing an open bottle under the dispensing orifice of the cap of the dispensing device of claim 9;

opening the cap by moving the mobile head away from the fixed body;

letting the cosmetic composition flow until the bottle is filled to a set level;

closing the cap by moving the mobile head closer to the fixed body; and closing the bottle and moving the bottle away from the dispensing device.

13. The device of claim 10, wherein the opening and closing of the cap comprises using the handle to actuate the cap.

* * * * *